US006756330B1

(12) United States Patent
Heirbaut et al.

(10) Patent No.: US 6,756,330 B1
(45) Date of Patent: Jun. 29, 2004

(54) KNITTED FABRIC OF STEEL FIBERS WITH INCREASED NUMBER OF STITCHES

(75) Inventors: Guido Heirbaut, Temse (BE); Wim Van Steenlandt, Sint-Niklaas (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/869,759

(22) PCT Filed: Dec. 9, 1999

(86) PCT No.: PCT/EP99/09717

§ 371 (c)(1),
(2), (4) Date: Oct. 2, 2001

(87) PCT Pub. No.: WO00/40792

PCT Pub. Date: Jul. 13, 2000

(30) Foreign Application Priority Data

Jan. 8, 1999 (BE) ..... 99200039

(51) Int. Cl.[7] ..... C03B 27/00; D04B 1/14; D04B 9/42

(52) U.S. Cl. ..... 442/316; 442/304; 442/312; 65/41; 65/69; 65/95; 65/104; 65/114

(58) Field of Search ..... 442/304, 312, 442/316; 65/41, 69, 95, 104, 114

(56) References Cited

U.S. PATENT DOCUMENTS

| | | | | |
|---|---|---|---|---|
| 3,379,000 A | | 4/1968 | Webber et al. | 57/139 |
| 4,220,112 A | | 9/1980 | Neilsen | 116/56 |
| 4,930,199 A | | 6/1990 | Yanagisawa | 29/4.51 |
| 5,388,432 A | | 2/1995 | Lesage et al. | 66/202 |
| 5,631,067 A | * | 5/1997 | Anaf et al. | 428/213 |

FOREIGN PATENT DOCUMENTS

| | | |
|---|---|---|
| EP | 0 477 785 | 4/1992 |
| EP | 0 502 756 | 9/1992 |
| WO | 94/01372 | 1/1994 |
| WO | 94/01373 | 1/1994 |
| WO | 97/04152 | 2/1997 |
| WO | 97/08108 | 3/1997 |
| WO | 98/32402 | 7/1998 |
| WO | 99/47738 | 9/1999 |

OTHER PUBLICATIONS

"Austenitic stainless steels, 316L", Marks' Standard Handbook for Mechanical Engineers, 1996.*

"Yarn". Complete Textile Glossary, Celanase Acetate, 2001.*

* cited by examiner

*Primary Examiner*—Ula C. Ruddock
*Assistant Examiner*—Jennifer Boyd
(74) *Attorney, Agent, or Firm*—Foley & Lardner LLP

(57) ABSTRACT

A knitted fabric comprises fibers. At least part of these are metal fibers. The fabric has 90 or more stitches per square centimeter. The fabric is used as a separation cloth (12) between mould (11) and glass (14). The increased number of stitchers per square centimeter reduces the risks for markings on the glass.

58 Claims, 3 Drawing Sheets

KNITTED FABRIC OF STEEL FIBERS WITH INCREASED NUMBER OF STITCHES

FIELD OF THE INVENTION

The invention relates to a knitted fabric comprising fibres (fibers), at least part of these fibres being metal fibres and the use of such fabric as a separation cloth for moulds in glass bending processes.

BACKGROUND OF THE INVENTION

Such knitted fabrics comprising metal fibres are described in the PCT-patent applications WO97/04152, WO94/01372 and WO94/01373 and are utilised in various fields of application.

The use of a textile fabric as separation cloth between mould and glass, to form side-lites and back-lites for automotive business is known. During this contact, temperatures of 650 to 700° C. are used. It is of great importance that no marks are left on the glass surface after the contact of the glass and the textile fabric.

The use of textile fabrics out of 100% glass fibres is known. The disadvantage of these glass fibre cloths is that it doesn't resist the mechanical action during the glass shaping process. Also the use of textile fabrics, partially or fully consisting out of metal fibres is known. Using these fabrics as mould coverings, the mechanical action of the bending process is withstand better, but there is still the risk of marking the glass, by transferring the woven or knitted pattern into the glass surface which has contacted the textile fabric.

Further, it is known that the use of knitted structures is more suitable to cover moulds, since knitted surfaces can be draped better on moulds and less or no folds will be created when bending the knitted fabric, especially on three-dimensionally shaped surfaces or moulds.

The risk of having marks, caused by use of textile fabrics as the separation cloth for moulds in glass bending processes, is influenced by several parameters, such as glass temperature and pressure used to bend the glass. Since for example the automotive industry requires more complex glass surfaces, that is glasses which show a deeper bend, the glass has to be heated to a higher temperature and the pressure to bend the glass, is increased as well. These two adjustments to the production parameters of the bending process, makes the glass more sensitive to markings since higher temperature makes the glass softer, and creates a more obvious transfer of the textile structure, either woven or knitted, on the glass surface because of the higher pressure.

Another parameter that influences the risk of marking, is the wear of the textile fabric, used as a separation cloth between moulds and glass, due to the repetitive contacts with glass sheets, and the temperature. This temperature makes the fibres become more sensitive to breaking forces, and the mechanical action of the glass sheets against the fabric makes the fabric wear out little by little. Since the fibres which are standing out on the yarn surface, will suffer most on this mechanical action, and so will disappear after several contacts with glass, the stitches out of which the knitted fabric is made or the weaving pattern, used to provide the woven fabric, will be transferred more obviously to the glass surface.

Separation cloths should preferably meet next requirements:

1. The cloth should resist the bending temperature. Typically, these temperatures raise up to 700° C. when the bending takes place in the heated part of the furnace. When the glass bending takes place out of the furnace, this temperature will be less.
2. The cloth should be able to follow the mould shape as close as possible.
3. The separation material should show enough air permeability. It is taken as a limit that separation cloths should at least have an air permeability of 2400 l/10 $cm^{2*}h$, and preferably more than 4500 l/10 $cm^{2*}h$.
4. The weight of the separation cloth is preferably between 600 $g/m^2$ and 2000 $g/m^2$. Fabrics with less weight usually wear out too fast, where too heavy fabrics tend to elongate too much under its own weight, so causing obstruction in the furnace for the glasses to pass in the neighbourhood of the fabric before or after the bending action.
5. The thickness for the separation cloth is preferably more than 0.8 mm and even better more than 1 mm. Too thin fabrics show a lack of elasticity in the direction perpendicular to the fabric surface.
6. And as already mentioned, the risk for remaining marks on the glass surface should be reduced to a minimum.

The higher the number of requirements met, the better the performance of the separation cloth between mould and glass in the glass bending process will be.

SUMMARY OF THE INVENTION

It is an object of the present invention to provide a fabric with a reduced risk for markings on the glass surface.

It is also an object of the present invention to provide a fabric which meets all of the above-mentioned minimum requirements.

The invention relates to a knitted fabric, which comprises fibres, at least part of these fibres being metal fibres, and which has more than 90 stitches per square centimetre.

Preferably the knitted fabric has more than 95, most preferably more than 100, e.g. more than 105 or even more than 110 stitches per square centimetre.

The first requirement, being the resistance to the temperatures used for the bending of the glass, is met by the use of metal fibres, usually stainless steel fibres.

Possibly, other high temperature fibres, such as glass fibres, ceramic fibres, TWARON®, NOMEX®, meta-aramid fibres, para-aramid fibres, carbon fibres, preox-fibres and other high temperature resistant man-made fibres can be used, next to the metal fibres. The fibres, of which at least one are metal fibres, can be intimately blended and possibly plied to a two or more plied yarn or the yarn can be a two- or more plied yarn, where some or all of the single yarns are made out of one fibre type.

By plying yarns, it is meant that two or more yarns are given a torsion round the direction of the axis's of the yarns.

To meet the second requirement, being the drapeability, usually knitted structures are used.

The other characteristics, air permeability, thickness, weight and number of stitches, are largely influenced by the gauge of the knitting machine, the metrical number of the used yarns, the knitting structure and the settings of the knitting machine during the knitting action. The higher the number of stitches per square centimetre, the heavier and thicker the fabric and the lower the air permeability. The inventors, however, have discovered that the risk for glass markings can be substantially reduced, if not avoided, if the fabric has a higher number of stitches per surface unit and that this higher number of stitches can be reached with values of air permeability, thickness and weight which still fall within the above-mentioned ranges.

The reduced risk for markings on the glass surface can be explained as follows:

To reduce the risk on creating marks on the bent glass surface, it is important to use a fabric with as much yarn surface as possible on the fabric side which contacts the glass during the bending operation. This for 2 reasons:

1. By having more yarn surface on this contact side, the force to bend the glass is distributed over more contact surface. The depth to which extend the fabric might be pressed into the softened glass largely depends on this force per surface, so less force per unit decreases the risk on having a too large impression of the fabric in the glass, and so creating marks on the glass surface.
2. Because this less force per contact surface unit, the wear due to the repetitive mechanical action on the fabric surface will be reduced. This makes the time to have too much yarn pronunciation longer and the risk to have marks will be decreased in time.

The yarns which can be used to realise fabrics, as subject of the invention are made out of metal fibres, usually stainless steel fibres, possibly blended with glass fibres or ceramic fibres, other high temperature fibres, such as TWARON®, NOMEX®, meta-aramid fibres, para-aramid fibres, carbon fibres, preox-fibres and other high temperature resistant man-made fibres. The fibres, of which at least a part being metal fibres, can be intimately blended and possibly plied to a two or more plied yarn or the yarn can be a two- or more plied yarn, where some or all of the single yarns are made out of one fibre type.

At least partially, the yarns will contain metal fibres. Usually, but not necessarily, stainless steel fibres are used. Alloys such as AISI 316 or AISI 316L, AISI 347, or other alloys out of the AISI 300 type are used. Also alloys out of the AISI-400 type or Aluchrome-type alloys can be used. These fibres can be bundle drawn, as described in patent U.S. Pat. No. 3,379,000, be made by shaving them from a coil, as described in patent U.S. Pat. No. 4,930,199 or melt extracted. Also metal fibres produced as described in U.S. Pat. No. 4,220,112 can be used.

These metal fibres have an equivalent diameter usually between 1 and 100 $\mu$m, and more typically between 6 and 25. The equivalent diameter is the diameter of the circle, which has the same surface as the fibre section when cut perpendicularly to the axis of the fibres.

Typically, the fabric which is subject of the invention, has an air permeability of more than 2400 l/10 $cm^2$*h and preferably more than 4500l/10 $cm^2$*h. The weight of the fabric will be more than 600 $g/m^2$ and less than 2000 $g/m^2$. The thickness of the fabric will be not less than 0.8 mm and preferably more than 1 mm.

Different knitting structures can be used to provide the fabric as subject of the invention. It was found that knitting structures single jersey ½, single jersey ⅓ and single jersey ¼ can be used to provide knitted fabrics, comprising metal fibres with more than 90 stitches per square centimetre. Other single jersey structures, with more floating yarns such as single jersey ⅕, single jersey ⅙ or more, can be used.

By single jersey structures is meant a knitting structure, obtainable by using one needle bed, providing one stitch for every needle in the needle bed per row of stitches.

Different gauges can be used to provide the fabric as subject of the invention. The gauge are the number of needles per inch on the needle bed or beds of the knitting machine. Typically gauges from 10 to 32 can be used. However it is shown that to obtain more than 90 stitches per $cm^2$, gauge 16 or more should be used. Best fabrics were provided using gauge 20 or more, such as gauge 22 or more.

Different yarns with different metrical numbers can be used to provide the fabric as subject of the invention. The metrical number (Nm) of a yarn, as mentioned in the list, is an expression for the fineness of the yarn. It gives you the length of yarn that has a weight of 1 gram. For reason of comparison, all metrical numbers were recalculated as if all fibres were metal fibres of type AISI 316L. To obtain a fabric as subject of the invention, yarns with metrical number Nm 5.5 can be used. Finer yarns such as Nm 7.5 or Nm 10 could also be used to reach 90 or more stitches per $cm^2$.

Reinforcement multifilament weft yarns with a titre of less than 180 tex, such as e.g. metal yarn or glass fiber yarns, can be incorporated, as described in the international application number PCT/BE98/0010.

A fabric as subject of the present invention, with two surfaces having a different fibre content can be provided by using the plating technique as described in Belgian patent application number 9800212.

According to another aspect of the present invention, there is provided a use of a fabric according to any one of the preceding fabrics for covering moulds and tempering or press-on rings which are utilised in the process of forming glass plates, or for covering the means of transport by which glass plates are moved during the forming process.

Still according to the present invention, there is provided a method for reducing the risk for marking the glass surface during bending.

BRIEF DESCRIPTION OF THE DRAWINGS

The embodiments of the invention will be explained by making use of next figures

DESCRIPTION OF THE PREFERRED EMBODIMENTS OF THE INVENTION

Figure 1:
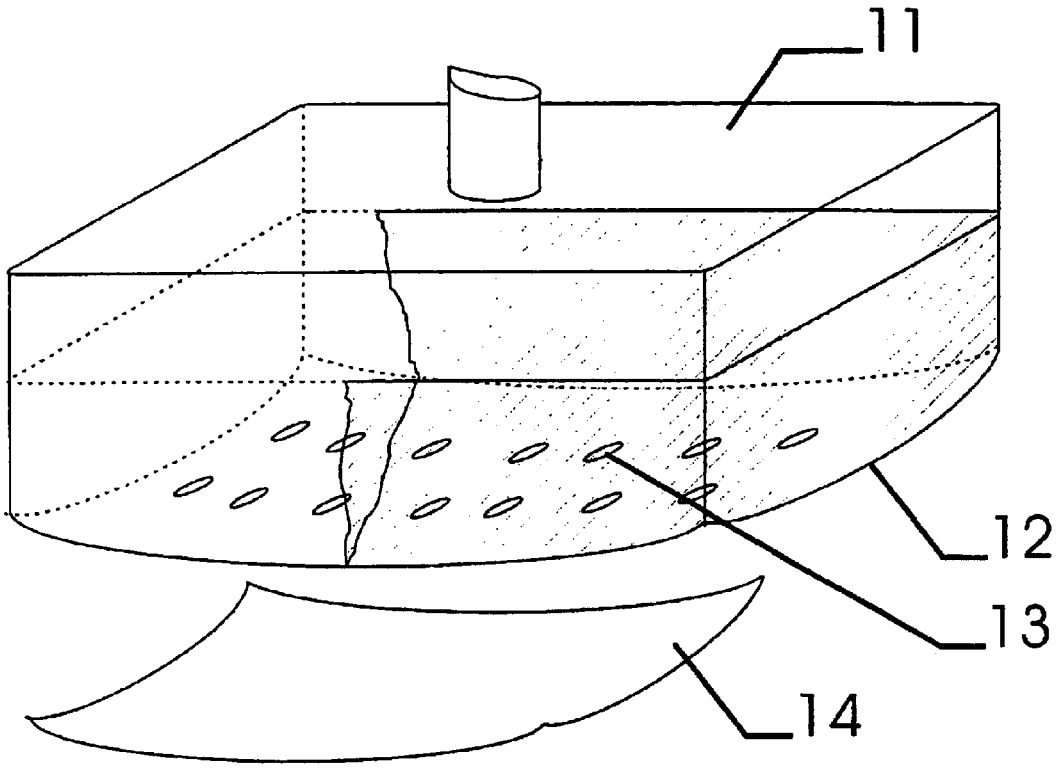
FIG. 1 shows a mould on which a separation cloth is mounted.

A schematic drawing of a glass shaping mould, covered with separation) is given in FIG. 1. The mould 11 is here covered by a separation cloth 12 (shown partially). The glass 14, which is initially pre-shaped but flat, is brought in contact with the mould 11 and the separation cloth 12, to transfer the shape of the mould into the glass 14. This can be done on many different ways. There is always a vacuum created between mould 11 and glass 14 when the glass 14 is in contact with the mould 11. Therefore air is sucked through the mould perforations 13 and through the separation cloth 12.

Figure 2:
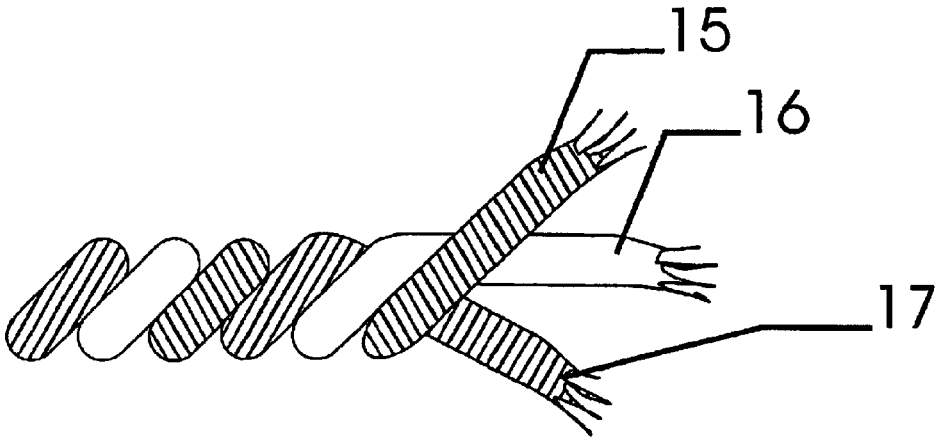
FIG. 2 shows a side view on a yarn with single yarns which are an intimate blend of different fibres

It is part of the invention that the yarns, used to provide the knitted fabric as subject of the invention, comprises metal fibres. Metal fibres can be incorporated in the yarns of the fabric on different ways. It can be done as shown in FIG. 2, by plying a single yarn, out of 100% metal fibres 15, with other single yarns 16 and 17, e.g. made 100% out of an other heat resistant fibre, or a blend out of two or more different heat resistant fibre types. The type of heat resistant fibres used to make the different single yarns 16 and 17 are not necessarily the same types, and the compositions are not necessarily the same. These single yarns 15, 16 and 17 can be multifilament yarns or spun yarns, e.g. rotor- or open end spun yarn, or ringspun yarn.

Figure 3:
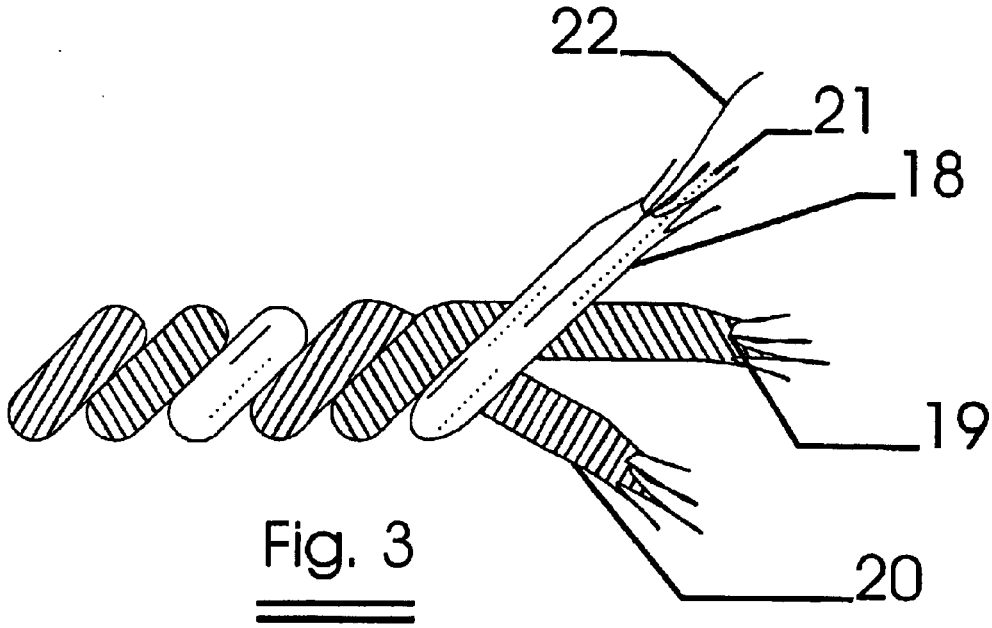
FIG. 3 shows a side view on a yarn with single yarns which consist out of one type of fibres.

An other way of incorporating metal fibres in the yarns is by plying different single yarns, from which at least on single yarn consists is a blend of metal fibres and at least one non metallic, high temperature resistant fibre type. This is shown in FIG. 3, where single yarn 18 is made out of metal fibres 21 and non metallic fibres 22. The other single yarns 19 and 20 are e.g. made 100% out of other heat resistant fibres, or a blend out of two or more different heat resistant fibre types. The type of heat resistant fibres used to make the different single yarns 18, 19 and 20 are not necessarily the same types, and the compositions are not necessarily the same. The single yarns 18, 19 and 20 can be multifilament yarns or spun yarns, e.g. rotor- or open end spun yarn, or ringspun yarn.

Figure 6:
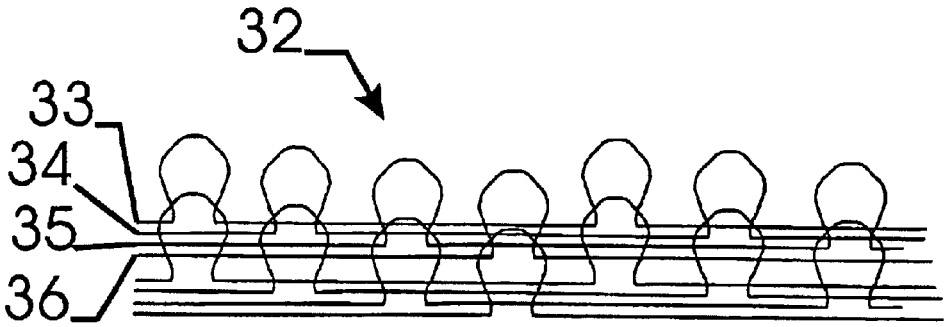
FIG. 6 shows the knitted structure hereafter called "single jersey ¼"
Figure 7:
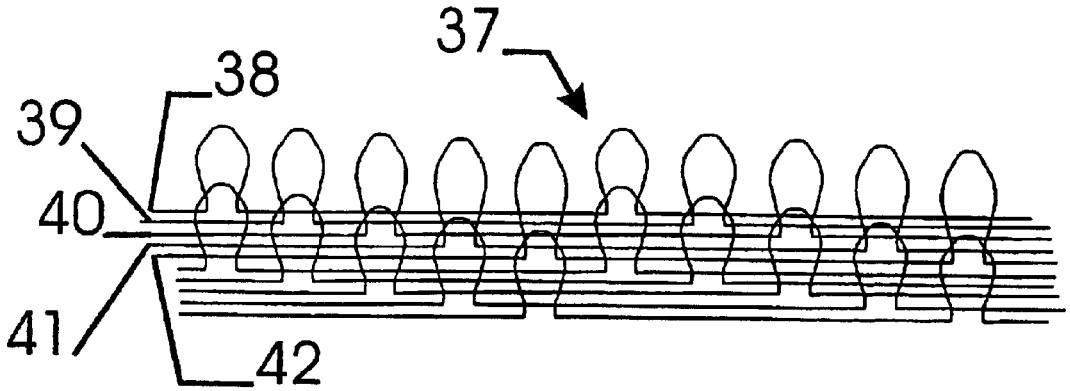
FIG. 7 shows the knitted structure hereafter called "single jersey ⅕"

Some embodiments of the present invention is given in the table underneath, where for different knitted structures, gauge, yarn Nm and knitting structure are given, together with the number of stitches per $cm^2$, thickness, weight and air permeability. All yarns used for these examples are made out of 100% stainless steel fibres, with fibre diameters of 12 $\mu$m. The alloy used is AISI 316L.

needle. FIG. 6 shows "single jersey ¼" 32, where a yarn 33, 34, 35 or 36 is knitted every fourth needle and so 4 yarns are used to make one row of stitches. In the same sense, FIG. 7 shows "single jersey ⅕" 37, where a yarn 38, 39, 40, 41 or 42 is knitted every fifth needle and so 5 yarns are used to make one row of stitches.

What is claimed is:

1. A knitted fabric, comprising fibers, at least part of these fibers being metal fibers, said fabric having 90 or more stitches per square centimeter and having an air permeability higher than 2400 l/10 $cm^{2*}$ h.

2. A knitted fabric according to claim 1, said fabric having 100 or more stitches per square centimeter.

3. A knitted fabric according to claim 1, having a weight between 600 g/$m^2$ and 2000 g/$m^2$.

4. A knitted fabric according to claim 1, having a thickness more than 0.8 mm.

5. A knitted fabric of claim 1, wherein all of said fibers are metal fibers.

6. A knitted fabric of claim 1, wherein all of said fibers are stainless steel fibers.

7. A knitted fabric of claim 6, in which the stainless steel contains at least 16% Cr and 10% Ni.

8. A knitted fabric of claim 1, having the single jersey ½ structure.

9. A knitted fabric of claim 1, having the single jersey ⅓ structure.

10. A knitted fabric of claim 1, having the single jersey ¼ structure.

11. A method of making a knitted fabric comprising utilizing a knitting machine with gauge equal to or more than 20 to produce a knitted fabric according to claim 1.

12. A method of making a knitted fabric comprising utilizing a knitting machine with gauge equal to or more than 22 to produce a knitted fabric according to claim 1.

| Embodiment | gauge | structure | yarn (Nm) | stitches (/$cm^2$) | air permeability (l/10 $cm^2$*h) | thickness (mm) | weight (g/$m^2$) |
|---|---|---|---|---|---|---|---|
| embodiment 1 | 16 | single jersey 1/3 | 7.5 | 91 | 6720 | 1.00 | 882 |
| embodiment 2 | 20 | single jersey 1/2 | 5.5 | 94.1 | 4550 | 1.25 | 1010 |
| embodiment 3 | 20 | single jersey 1/2 | 7.5 | 100.3 | 6750 | 1.00 | 741 |
| embodiment 4 | 20 | single jersey 1/3 | 5.5 | 101.1 | 3540 | 1.5 | 1192 |
| embodiment 5 | 20 | single jersey 1/3 | 7.5 | 124.5 | 4365 | 1.25 | 990 |
| embodiment 6 | 20 | single jersey 1/4 | 7.5 | 111.1 | 4639 | 1.35 | 1090 |
| embodiment 7 | 24 | single jersey 1/2 | 5.5 | 96.7 | 5720 | 1.05 | 1016 |
| embodiment 8 | 24 | single jersey 1/2 | 7.5 | 106.0 | 8960 | 0.8 | 757 |
| embodiment 9 | 24 | single jersey 1/3 | 5.5 | 109.3 | 4836 | 1.20 | 1121 |
| embodiment 10 | 24 | single jersey 1/3 | 7.5 | 123.6 | 5200 | 1.10 | 986 |
| embodiment 11 | 24 | single jersey 1/3 | 10 | 136.6 | 5800 | 0.95 | 826 |
| embodiment 12 | 24 | single jersey 1/4 | 5.5 | 96.1 | 3828 | 1.4 | 1320 |
| embodiment 13 | 24 | single jersey 1/4 | 7.5 | 114.5 | 4970 | 1.3 | 948 |

The air permeability is measured conform the international standard ISO 9237. Thickness is measured conform ISO 5084 and weight is measured conform ISO 3801.

The knitting structure is the way how the different stitches are made out of different yarns.

FIGS. 4 to 7 explains what is meant by the knitting structures single jersey ½, single jersey ⅓, single jersey ¼ and single jersey ⅕.

Figure 4:
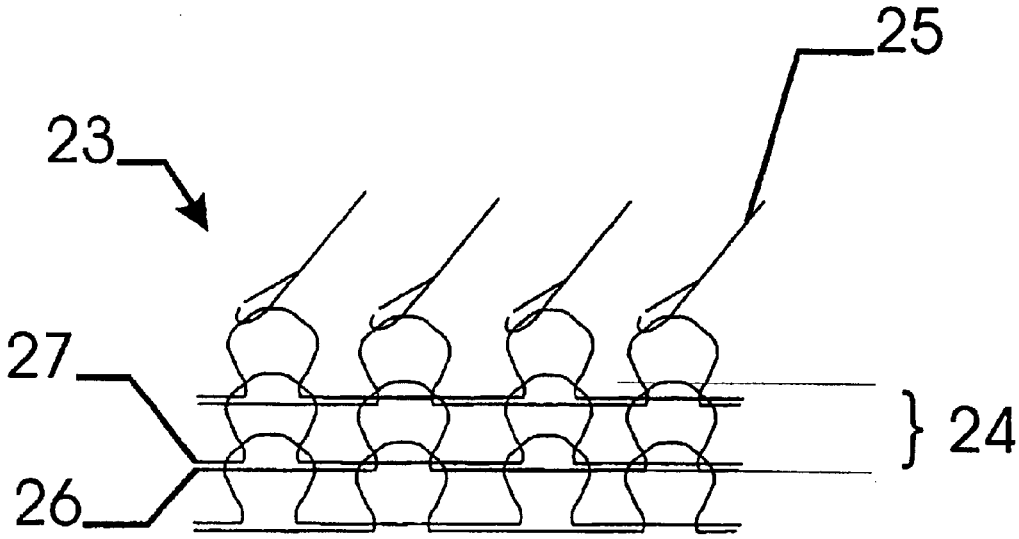
FIG. 4 shows the knitted structure hereafter called "single jersey ½"
Figure 5:
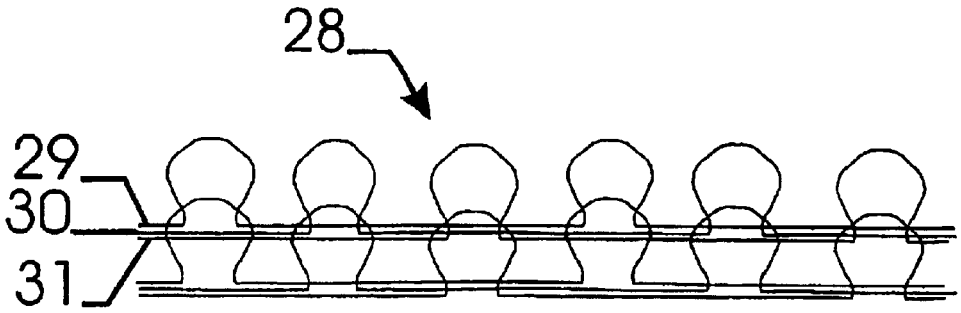
FIG. 5 shows the knitted structure hereafter called "single jersey ⅓"

FIG. 4 shows the knitting structure using "single jersey ½" 23, where each row of stitches 24 is made out of two yarns 26 and 27. The first yarn 26 makes stitches on every second needle 25 on the needle bed, where the second yarn 27 is only knitted in the same stitch row on the needles 27 which are not used by yarn 26. As seen in FIG. 5, "single Jersey ⅓" 28 needs three yarns 29, 30 and 31 to make one stitch row, because each yarn makes a stitch on every third

13. A knitted fabric of claim 1, comprising yarns with metrical number equal to or larger than 5.5.

14. A knitted fabric of claim 1, comprising yarns with metrical number equal to or larger than 7.5.

15. A knitted fabric of claim 1, comprising yarns with metrical number equal to or larger than 10.

16. A method of forming glass plate, comprising covering a mould, a tempering or a press-on ring with a fabric according to claim 1 and forming a glass plate.

17. A method for reducing the risk for marking on a glass plate during bending of the glass plate, said method comprising the steps: (a) providing fibers, at least part of these fibers being metal fibers, (b) knitting said fibers into a fabric, such that said fabric has 90 or more stitches per square centimeter and has an air permeability higher than 2400 l/10 $cm^{2*}$ h.

18. A method of forming glass plates, comprising providing a transportation device adapted to move a glass plate during the forming process, covering the transportation device with a fabric according to claim 1, and forming a plate.

19. A knitted fabric according to claim 1, having an air permeability higher than 4500 l/10 $cm^{2*}h$.

20. A knitted fabric according to claim 19, having a weight between 600 $g/m^2$ and 2000 $g/m^2$.

21. A glass mould assembly, comprising:

a glass mold having a surface; and a knitted fabric covering at least a portion of the surface, wherein the knitted fabric comprises fibers, at least part of these fibers being metal fibers, the fabric having 90 or more stitches per square centimeter, and having an air permeability higher than 2400 l/10 $cm^{2*}h$.

22. A glass mould assembly according to claim 21, wherein the fabric has an air permeability higher than 4500 l/10 $cm^{2*}h$.

23. A glass mould assembly according to claim 22, wherein the fabric has a weight between 600 $g/m^2$ and 2000 $g/m^2$.

24. A glass mould assembly according to claim 21, wherein the fabric has more than 110 stitches per square centimeter.

25. A glass mould assembly according to claim 24, wherein the fabric has an air permeability higher than 4500 l10 $cm^{2*}h$.

26. A glass mould assembly according to claim 25, having a weight between 600 $g/m^2$ and 2000 $g/m^2$.

27. A glass mould assembly according to claim 21, wherein the knitted fabric further comprises glass fibers.

28. A glass mould assembly according to claim 21, wherein the knitted fabric further comprises ceramic fibers.

29. A glass mould assembly according to claim 21, wherein the knitted fabric comprises a plied yarn, wherein the plied yarn comprises a yarn consisting of metal fibers and a yarn comprising one of glass fibers and ceramic fibers.

30. A glass mould assembly according to claim 21, wherein the knitted fabric comprises a plied yarn, wherein the plied yarn comprises a first yarn consisting of metal fibers and a second yarn comprising a non-metallic fiber.

31. A glass mould assembly according to claim 30, wherein the plied yarn comprises a third yarn comprising a fiber different than the fiber of the second yarn.

32. A glass mould assembly according to claim 21, wherein the knitted fabric comprises a plied yarn, wherein the plied yarn comprises a first yarn comprising a blend of metallic and non-metallic fibers.

33. A glass mould assembly according to claim 32, wherein the plied yarn comprises a second yarn comprising a blend of metallic and non-metallic fibers.

34. A glass mould assembly according to claim 21, wherein the knitted fabric has two surfaces, and wherein the two surfaces have a different fiber content.

35. A glass mould assembly according to claim 21, said fabric having 100 or more stitches per square centimeter.

36. A glass mould assembly according to claim 21, wherein the fabric has a thickness more than 0.8 mm.

37. A glass mould assembly according to claim 21, wherein all of said fibers are metal fibers.

38. A glass mould assembly according to claim 21, wherein all of said fibers are stainless steel fibers.

39. A glass mould assembly according to claim 21, wherein the fabric has a single jersey ½ structure.

40. A glass mould assembly according to claim 21, wherein the fabric has a single jersey ⅓ structure.

41. A glass mould assembly according to claim 21, wherein the fabric has a single jersey ¼ structure.

42. A glass mould assembly according to claim 21, wherein the fabric comprises yarns with a metrical number equal to or larger than 5.5.

43. A glass mould assembly according to claim 21, wherein the fabric comprises yarns with a metrical number equal to or larger than 7.5.

44. A glass mould assembly according to claim 21, wherein the fabric comprises yarns with a metrical number equal to or larger than 10.

45. A method of forming glass plates, comprising:

providing a glass mold having a surface; and covering at least a portion of the surface with a knitted fabric according to claim 1;

creating a vacuum behind the knitted fabric and the surface; and placing a piece of glass in contact with the knitted fabric so that the vacuum draws the piece of glass to the knitted fabric and the surface.

46. The method according to claim 45, wherein said fabric has 100 or more stitches per square centimeter.

47. The method according to claim 45, wherein said fabric has a weight between 600 $g/m^2$ and 2000 $g/m^2$.

48. The method according to claim 45, wherein said fabric has a thickness of more than 0.8 mm.

49. The method according to claim 45, wherein all of said fibers are metal fibers.

50. The method according to claim 45, wherein all of said fibers are stainless steel fibers.

51. The method according to claim 45, wherein the fabric has a single jersey ½ structure.

52. The method according to claim 45, wherein the fabric has a single jersey ⅓ structure.

53. The method according to claim 45, wherein the fabric has a single jersey ¼ structure.

54. The method according to claim 45, wherein the fabric comprises yarns with a metrical number equal to or larger than 5.5.

55. The method according to claim 45, wherein the fabric comprises yarns with a metrical number equal to or larger than 7.5.

56. The method according to claim 45, wherein the fabric comprises yarns with a metrical number equal to or larger than 10.

57. The method according to claim 45, further comprising bending the piece of glass around at least a portion of the curved surface.

58. The method according to claim 21, wherein the glass mold has a curved surface.

* * * * *